US008654984B2

(12) United States Patent
Vos

(10) Patent No.: US 8,654,984 B2
(45) Date of Patent: Feb. 18, 2014

(54) PROCESSING STEREOPHONIC AUDIO SIGNALS

(75) Inventor: Koen Vos, San Francisco, CA (US)

(73) Assignee: Skype, Dublin (IE)

( * ) Notice: Subject to any disclaimer, the term of this patent is extended or adjusted under 35 U.S.C. 154(b) by 469 days.

(21) Appl. No.: 13/094,322

(22) Filed: Apr. 26, 2011

(65) Prior Publication Data

US 2012/0275604 A1 Nov. 1, 2012

(51) Int. Cl.
*H04R 5/00* (2006.01)

(52) U.S. Cl.
USPC ..... 381/17; 381/6; 381/14; 381/16; 381/22; 381/23; 700/94

(58) Field of Classification Search
USPC ..... 381/17, 2, 6, 14, 16, 22, 23; 700/94
See application file for complete search history.

(56) References Cited

U.S. PATENT DOCUMENTS

2007/0016316 A1* 1/2007 Hanna ..... 700/94

FOREIGN PATENT DOCUMENTS

| | | |
|---|---|---|
| EP | 2375409 | 10/2011 |
| WO | WO-03085643 | 10/2003 |
| WO | WO-2009141775 | 11/2009 |

OTHER PUBLICATIONS

"International Search Report and Written Opinion", Application No. PCT/EP2012/057653, (Jul. 30, 2012), 12 pages.
Lindblom, J., Plasberg, J. H., and Wafin, R., "Flexible Sum-Difference Stereo Coding Based on Time-Aligned Signal Components," 2005 IEEE Workshop on Applications of Signal Processing to Audio and Acoustics, 255-258 (Oct. 16-19, 2005).
Johnston, J. D., and Ferreira, A. J., "Sum-Difference Stereo Transform Coding," IEEE International Conference on Acoustics, Speech and Signal Processing II-569-II-572, (Mar. 1992).

* cited by examiner

*Primary Examiner* — Vivian Chin
*Assistant Examiner* — Paul Kim
(74) *Attorney, Agent, or Firm* — Sonia Cooper; Jim Ross; Micky Minhas

(57) ABSTRACT

Method, apparatus and computer program product for processing an input stereophonic audio signal to thereby generate a converted stereophonic audio signal representing the input stereophonic audio signal, the input stereophonic audio signal comprising a left input audio signal and a right input audio signal, and the converted stereophonic audio signal comprising a first converted audio signal and a second converted audio signal. The first converted audio signal is generated based on the sum of the left input audio signal and the right input audio signal. The second converted audio signal is generated based on the difference between a first function of the left input audio signal and a second function of the right input audio signal. The first and second functions are adjustable to thereby adjust at least one characteristic of the converted stereophonic audio signal.

29 Claims, 5 Drawing Sheets

PROCESSING STEREOPHONIC AUDIO SIGNALS

FIELD OF THE INVENTION

The present invention relates to processing stereophonic audio signals.

BACKGROUND

A stereophonic audio signal is made up from a plurality of audio signals (or audio "channels"). For example a stereophonic audio signal may be recorded by using a plurality of microphones at different locations whereby each microphone provides a separate audio signal which is captured at its respective location. The individual audio signals can be combined to provide a more complete sounding, stereophonic audio signal. Humans often perceive stereophonic audio signals to be at a higher audio quality than each of the individual audio signals which make up the stereophonic audio signal. Stereophonic audio signals can be output from a plurality of speakers to provide a stereophonic audio signal to a user.

In one example, a stereophonic audio signal comprises a "left" signal (L) and a "right" signal (R). The terms "left" and "right" used herein do not necessarily indicate relative positions of the signals. Such a stereophonic audio signal may be output from two speakers which are located at different positions in order to provide a stereophonic experience to a user listening to the outputted stereophonic audio signal. It may be desired to transmit or store the stereophonic audio signal, and in order to do this the stereophonic audio signal may be encoded (e.g. in the digital domain). The two signals, L and R, may be encoded separately using respective mono encoders. This provides a simple, efficient method for encoding the audio signals. Separately encoding the left and right channels with two mono codecs in this way is known as "dual-mono coding".

When encoding the stereophonic audio signal, a first aim is to keep the audio quality of the stereophonic audio signal as high as possible. That is when the encoded stereophonic audio signal is subsequently decoded it should be as close as possible to the original stereophonic audio signal. However, a second aim is for the encoded stereophonic audio signal to be represented using a small amount of data (i.e. it is desirable to have high coding efficiency). High coding efficiency is desirable for storing and transmitting the encoded stereophonic audio signal. The first and second aims may be conflicting.

A drawback of the dual-mono coding technique described above is that when the left and right channels are correlated, as is often the case, the encoded stereophonic audio signal is not efficiently coded. In other words, the dual-mono coding technique does not exploit the redundancy between the L and R channels and has thus suboptimal coding efficiency. Moreover, the two mono codecs may introduce quantization error components with a correlation that differs from the correlation between the L and R audio signal components. As a result those error components will appear separately from the signal in the spatial stereo image and thereby become more noticeable to a human listener. This effect is known as binaural unmasking. As described in "Sum-Difference Stereo Transform Coding" J. D. Johnston, A. J. Ferreira, IEEE International Conference on Acoustics, Speech and Signal Processing, March 1992, binaural unmasking relates to the perceptual system in human listeners being able to isolate noise spatially, and thereby unmask a noise component that is uncorrelated from a signal component that is correlated in two channels of a stereophonic audio signal (or unmask a noise component that, is correlated from a signal component that is uncorrelated in two channels of a stereophonic audio signal). In other words, if the correlation of the error components between the L and R signals does not match the correlation of the actual L and R audio signals then the errors are perceptually greater to human listeners.

An alternative coding technique to the dual-mono coding technique described above is a Mid/Side coding technique (described in "Sum-Difference Stereo Transform Coding" J. D. Johnston, A. J. Ferreira, IEEE International Conference on Acoustics, Speech and Signal Processing, March 1992), in which the left and right channels are converted to mid (M) and side (S) channels according to the formulas:

$$M=\tfrac{1}{2}(L+R) \text{ and}$$

$$S=\tfrac{1}{2}(L-R).$$

The signals on the mid and side channels are coded separately by mono codecs. It will be appreciated that the mid signal, M, represents the average of the left and right signals and the side signal, S, represents half of the difference between the left and right signals. The M and S signals can be encoded separately, e.g. for storage or transmission. In order to recover the stereophonic audio signal, a decoder can transform the signals on the M and S channels back to the left and right channel representations. For example, if a decoder receives a signal M' on the mid channel and a signal S' on the side channel, the signals on the left and right channels (L' and R') can be determined using the formulas:

$$L'=M'+S' \text{ and}$$

$$R'=M'-S'.$$

When compared with the dual-mono coding technique described above, the M/S coding technique improves coding efficiency and audio quality when the left and right signals are very similar to each other. This is because in this case, the side signal, S, will take a small value which can be represented using a small amount of data (e.g. a small number of bits) as compared to the amount of data required to represent either the left or right signal.

However, the M/S coding technique may not provide improved coding efficiency and audio quality when the L and R signals are not very similar.

SUMMARY

The inventor has realised that the M/S coding technique can be modified to provide a greater coding efficiency and audio quality than the M/S coding technique described above in some situations. In the new technique, a stereophonic audio signal may be coded by converting the left and right input channels to two new signals that may each be encoded by respective monophonic audio codecs. In preferred embodiments, the first of these signals is the mid signal (M) which is computed as the average of the left (L) and right (R) channels, i.e. $M=\tfrac{1}{2}(L+R)$, whilst the second of these signals is the side signal (S) and consists of a weighted difference between the two channels, i.e. $S=\tfrac{1}{2}((1-w)\,L-(1+w)\,R)$, with $-1\leq w\leq 1$. The scalar parameter w may be quantized and transmitted to a decoder, together with the coded signals M and S. The decoder may then decode the received mid and side signals (denoted M' and S'), and may subsequently convert the M' and S' signals back to representations of the left (L') and right (R') signals of the stereophonic audio signal using the formulas: $L'=(1+w)\,M'+S'$, and $R'=(1-w)\,M'-S'$.

According to a first aspect of the invention there is provided a method of processing an input stereophonic audio signal to thereby generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the method comprising: generating the first converted audio signal, wherein the first converted audio signal is based on the sum of the left input audio signal and the right input audio signal; and generating the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

Preferred embodiments provide two advantageous properties:

- one of the two converted audio signals (e.g. the first converted audio signal) corresponds to the mono version of the input stereophonic audio signal; and
- the other converted audio signal (e.g. the second converted audio signal) can be made zero whenever the left and right input audio signals differ only in a scale factor.

The first advantageous property described above allows for a reduced-complexity mono implementation of a decoder that receives the converted stereophonic audio signal. Such a mono implementation of the decoder uses less CPU and memory resources than a full stereo implementation of a decoder. The reason for this complexity saving is that a mono decoder only needs to decode the part of the bitstream of the converted stereophonic audio signal that contains the mono representation (i.e. the first converted audio signal, M), and can ignore the other part (i.e. the second converted audio signal, S). In practice this may reduce complexity and memory consumption in the decoder by approximately half (since conventionally, a mono decoder would be implemented by decoding left and right signals, and then calculating the average of these two signals to convert the stereo signal pair to a mono signal). This makes a mono decoder easier to implement and run on low-end hardware or gateways handling large numbers of calls, and saves battery life which is particularly important where, for example, the decoder is operated in a mobile device. A device in which the decoder is implemented might not have stereo playback capabilities and, as such, a stereo decoder would not improve perceived audio quality. Using the method described herein, a mono decoder would still be compatible with the converted stereophonic audio signal bitstream format. The first advantageous property thus greatly reduces the minimum hardware requirements for a bitstream-compatible decoder.

The second advantageous property described above improves coding efficiency and audio quality. When a weighted difference signal (e.g. the second converted audio signal, S) is small it may be encoded at a lower bitrate without reducing audio quality. In particular, when S is zero (or almost zero), no bits (or very few bits) need to be spent on coding the S audio signal. This may allow a greater number of bits to be used to encode the first converted audio signal, M, which can thereby improve the audio quality of the converted stereophonic audio signal. As an example, in the preferred embodiments described above (in which $M=\frac{1}{2}(L+R)$ and $S=\frac{1}{2}[(1-w)L-(1+w)R]$) the second converted audio signal, S can be adjusted to be zero by setting the scaling parameter, w, to be zero when the left and right input audio signals are identical (i.e. when L=R). In these preferred embodiments, S can also be made to be zero when the left input audio signal is zero by setting the scaling parameter, w to be equal to minus one. Furthermore, in these preferred embodiments, S can also be made to be zero when the right input audio signal is zero by setting the scaling parameter, w to be equal to one.

The second advantageous property described above also improves audio quality in the converted stereophonic audio signal by avoiding artefacts in the stereo image which may lead to binaural unmasking. Such artefacts are avoided by the M/S coding technique described in the background section only for the case in which the left and right input audio signals are identical. In contrast, in embodiments of the present invention, when the converted stereophonic audio signal is decoded, the correlation between quantization error in the left and right audio signals of the decoded stereophonic audio signal is equal to the correlation between the left and right input audio signals, whenever the left and right input audio signals are equal up to a scale factor (i.e. whenever a good approximation of the left input audio signal can be provided by applying some factor ($\alpha$) to the right input audio signal, that is when $L=\alpha R$). This results in optimal binaural masking of coding artefacts in the converted stereophonic audio signal.

The method may comprise encoding the first and second converted audio signals using respective mono encoders. The method may also comprise transmitting the converted stereophonic audio signal with an indication of the first and second functions to a decoder, wherein the indication may be transmitted once per frame of the stereophonic audio signal.

The method may further comprise analysing the right and left input audio signals to determine optimum functions for the first and second functions; and adjusting the first and second functions in accordance with the determined optimum functions. The optimum functions may be determined so as to minimise the second converted audio signal.

In preferred embodiments, the first and second functions are dependent upon each other. For example, the sum of the first and second functions may be constant as the functions are adjusted. In one example, the first converted audio signal, M, and the second converted audio signal, S, are given by:

$$M = \frac{1}{2}(L+R) \text{ and } S = \frac{1}{2}[(1-w)L-(1+w)R],$$

where L and R denote the left and right input audio signals respectively and w is a scaling parameter, wherein the first function is given by (1−w) and the second function is given by (1+w).

The at least one characteristic of the converted stereophonic audio signal may comprise at least one of a coding efficiency and an audio quality of the converted stereophonic audio signal.

The method may further comprise: analysing the right and left input audio signals; and switching to a dual-mono coding mode if the analysis of the right and left input audio signals indicates that doing so would improve the coding efficiency or the audio quality of the converted stereophonic audio signal.

The step of generating the second converted audio signal may comprise:

- applying the first function to the left input audio signal to generate an adjusted left input audio signal;
- applying the second function to the right input audio signal to generate an adjusted right input audio signal; and
- determining the difference between the adjusted left input audio signal and the adjusted right input audio signal.

The method may comprise:

determining the sum of the left and right input audio signals;

determining the difference between the left and right input audio signals; and applying an adjusting function to the determined sum of the left and right input audio signals to generate an adjusting signal, wherein the second converted audio signal is generated based on the difference between the adjusting signal and the determined difference between the left and right input audio signals.

The first and second functions may be first and second scaling factors. Alternatively, the first and second functions may be determined by filter coefficients of a prediction filter.

According to a second aspect of the invention there is provided an apparatus for processing an input stereophonic audio signal to thereby generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the apparatus comprising: first generating means configured to generate the first converted audio signal, wherein the first converted audio signal is based on the sum of the left input audio signal and the right input audio signal; and second generating means configured to generate the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

The apparatus may further comprise: a first mono encoder configured to encode the first converted audio signal; and a second mono encoder configured to encode the second converted audio signal. The apparatus may further comprise a transmitter configured to transmit the converted stereophonic audio signal with an indication of the first and second functions to a decoder.

According to a third aspect of the invention there is provided a method of generating an output stereophonic audio signal from a converted stereophonic audio signal which has been generated from an input stereophonic audio signal, said input stereophonic audio signal comprising a left input audio signal and a right input audio signal, and said converted stereophonic audio signal comprising a first converted audio signal and a second converted audio signal which are related to the left and right input audio signals according to at least one function, said output stereophonic audio signal comprising a left output audio signal and a right output audio signal, the method comprising: receiving the first and second converted audio signals with an indication of said at least one function; generating the right output audio signal, wherein the right output audio signal is based on the sum of the second converted audio signal and a first decoding function of the first converted audio signal; and generating the left output audio signal, wherein the left output audio signal is based on the difference between the second converted audio signal and a second decoding function of the first converted audio signal, wherein the first and second decoding functions are determined in accordance with the received indication of the at least one function such that the generated left and right output audio signals represent the left and right input audio signals.

The first converted audio signal may be based on the sum of the left input audio signal and the right input audio signal, and the second converted audio signal may be based on the difference between a first function of the left input audio signal and a second function of the right input audio signal, and the at least one function may comprise the first function and the second function.

The method may further comprise decoding the received first and second converted audio signals using respective mono decoders prior to said steps of generating the right output audio signal and generating the left output audio signal. The method may further comprise outputting the output stereophonic audio signal.

In preferred embodiments, the left output audio signal, L', and the right output audio signal, R', are given by:

$$L'=(1+w)M'+S' \text{ and } R'=(1-w)M'-S',$$

where M' and S' denote the received first and second converted audio signals respectively and w is a scaling parameter, wherein the third function is given by (1−w) and the fourth function is given by (1+w).

According to a fourth aspect of the invention there is provided a computer program product embodied on a non-transient, computer-readable medium and comprising code configured so as when executed on one or more processors of an apparatus to perform the operations in accordance with the method described above.

According to a fifth aspect of the invention there is provided an apparatus for generating an output stereophonic audio signal from a converted stereophonic audio signal which has been generated from an input stereophonic audio signal, said input stereophonic audio signal comprising a left input audio signal and a right input audio signal, and said converted stereophonic audio signal comprising a first converted audio signal and a second converted audio signal which are related to the left and right input audio signals according to at least one function, said output stereophonic audio signal comprising a left output audio signal and a right output audio signal, the apparatus comprising: a receiver configured to receive the first and second converted audio signals with an indication of said at least one function; first generating means configured to generate the right output audio signal, wherein the right output audio signal is based on the sum of the second converted audio signal and a first decoding function of the first converted audio signal; second generating means configured to generate the left output audio signal, wherein the left output audio signal is based on the difference between the second converted audio signal and a second decoding function of the first converted audio signal, and determining means configured to determine the first and second decoding functions in accordance with the received indication of the at least one function such that the generated left and right output audio signals represent the left and right input audio signals.

The apparatus may further comprise: a first mono decoder configured to decode the received first converted audio signal; and a second mono decoder configured to decode the received second converted audio signal.

According to a sixth aspect of the invention there is provided a system comprising: a first apparatus according to the second aspect of the invention for processing an input stereophonic audio signal to generate a converted stereophonic audio signal; and a second apparatus according to the fifth aspect of the invention for receiving the converted stereophonic audio signal and for generating an output stereophonic audio signal.

BRIEF DESCRIPTION OF THE DRAWINGS

For a better understanding of the present invention and to show how the same may be put into effect, reference will now be made, by way of example, to the following drawings in which.

DETAILED DESCRIPTION OF PREFERRED EMBODIMENTS

Preferred embodiments of the invention will now be described by way of example only.

Figure 1:
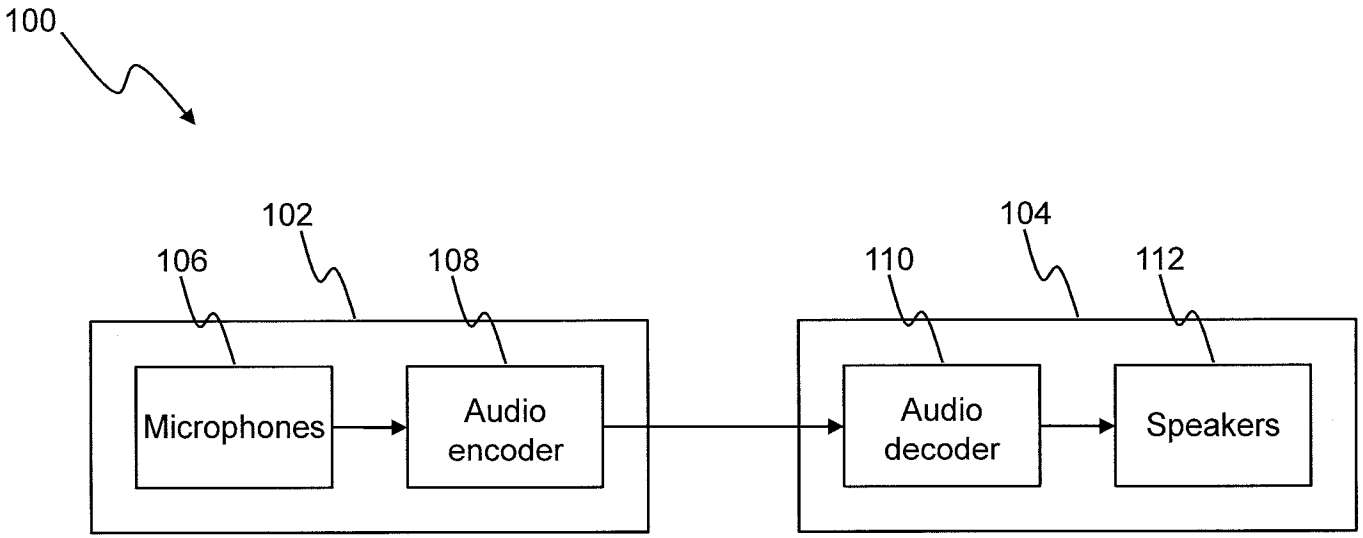
FIG. 1 shows a system according to a preferred embodiment.

FIG. 1 shows a system 100 according to a preferred embodiment. The system 100 includes a first node 102 and a second node 104. The first node 102 is arranged to receive a stereophonic audio signal, encode the stereophonic audio signal and transmit the encoded stereophonic audio signal to the second node 104. The second node 104 is arranged to decode the stereophonic audio signal received from the first node 102 and to output the stereophonic audio signal. For these purposes, the first node 102 comprises audio input means, such as microphones 106, and an audio encoder block 108, whilst the second node 104 comprises an audio decoder block 110 and audio output means, such as speakers 112. The microphones 106 are configured to receive a stereophonic audio signal and to pass the stereophonic audio signal to the audio encoder block 108. The audio encoder block 108 is configured to encode the stereophonic audio signal. The encoded stereophonic audio signal can be transmitted from the first node 102 (e.g. via a transmitter which is not shown in FIG. 1). The encoded stereophonic audio signal can be received at the second node 104 (e.g. using a receiver which is not shown in FIG. 1) and passed to the audio decoder block 110. The audio decoder block 110 is configured to decode the stereophonic audio signal. The decoding process of the audio decoder block 110 corresponds to the encoding process of the audio encoder block 108, such that the stereophonic audio signal can be correctly decoded. For example, the decoding process may be the inverse of the encoding process. The decoded stereophonic audio signal is passed from the decoder block 110 to the speakers 112 and is output from the speakers 112.

The microphones 106 are capable of receiving stereophonic audio signals. In order to receive stereophonic audio signals each of the microphones 106 is capable of receiving a separate input audio signal (such as a left audio signal or a right audio signal). Different types of microphones 106 for receiving stereophonic audio signals are known in the art and, as such, are not described in further detail herein. Similarly, the speakers 112 are capable of outputting stereophonic audio signals. In order to output stereophonic audio signals each of the speakers 112 is capable of outputting a separate audio signal (such as a left audio signal or a right audio signal). Different types of speakers 112 for outputting stereophonic audio signals are known in the art and as such as not described in further detail herein.

In one example, the microphones 106 record stereophonic audio signals that are present at the location of the first node 102, such as music or speech from a user of the first node 102. The stereophonic audio signals are processed and sent to and output from the speakers 112 of the second node 104, for example to a user of the second node 104. Stereophonic audio signals are often perceived as being of a higher quality than corresponding mono audio signals to human listeners.

Embodiments of the present invention relate to the processes used in the audio encoder block 108 and the audio decoder block 110 in order to allow efficient coding of stereophonic audio signals at a high quality for use in a system such as system 100.

In the M/S coding technique described above in the background section (in which M=(L+R)/2 and S=(L−R)/2), the coding efficiency and audio quality of the stereophonic audio signal may be poor when the left and right signals are highly correlated but differ in level. This situation may occur, for example, when a mono signal is "amplitude panned" to create a stereo signal. Amplitude panning is a technique commonly used in recording and broadcasting studios.

In one method an adaptive gain (g) is used when computing the difference signal, S, such that the mid and side signals (M and S) are given by the equations:

$$M=\tfrac{1}{2}(L+R)$$

$$S=\tfrac{1}{2}(L-gR).$$

These signals are coded separately and can be sent with the gain value g, to a decoder. The decoder receives mid and side signals (M' and S') and can transform these received signals back to left and right representations (L' and R') according to:

$$L'=2(gM'+S')/(1+g)$$

$$R'=2(M'-S')/(1+g).$$

The use of the adaptive gain value, g, can improve the quality of the coding of a stereophonic audio signal when the left and right signals are highly correlated and fairly close in level, because the gain value can be adapted such that the side signal, S, can have lower energy.

However, a drawback with the adaptive gain technique is that the performance is asymmetrical (i.e. it is different for the left and right audio signals). When the signal on the left channel is zero, the side signal S can be made zero by setting the gain to zero (g=0) and performance is good. When, on the other hand, the signal on the right channel is zero, the signal S becomes identical to the signal M, and coding efficiency suffers because the mono codecs code the same signal twice. Furthermore, performance may be poor when the level of the signal on the right channel is low and the gain g is large in order to minimize the signal S. In that case quantization noise in the right input signal is amplified, which may degrade the efficiency of the mono codec operating on the side signal S. For that reason, in practice the gain value g cannot become much larger than 1.

Embodiments of the present invention provide a coding technique which overcomes at least some of the problems of the adaptive gain coding technique described above.

Figure 2:
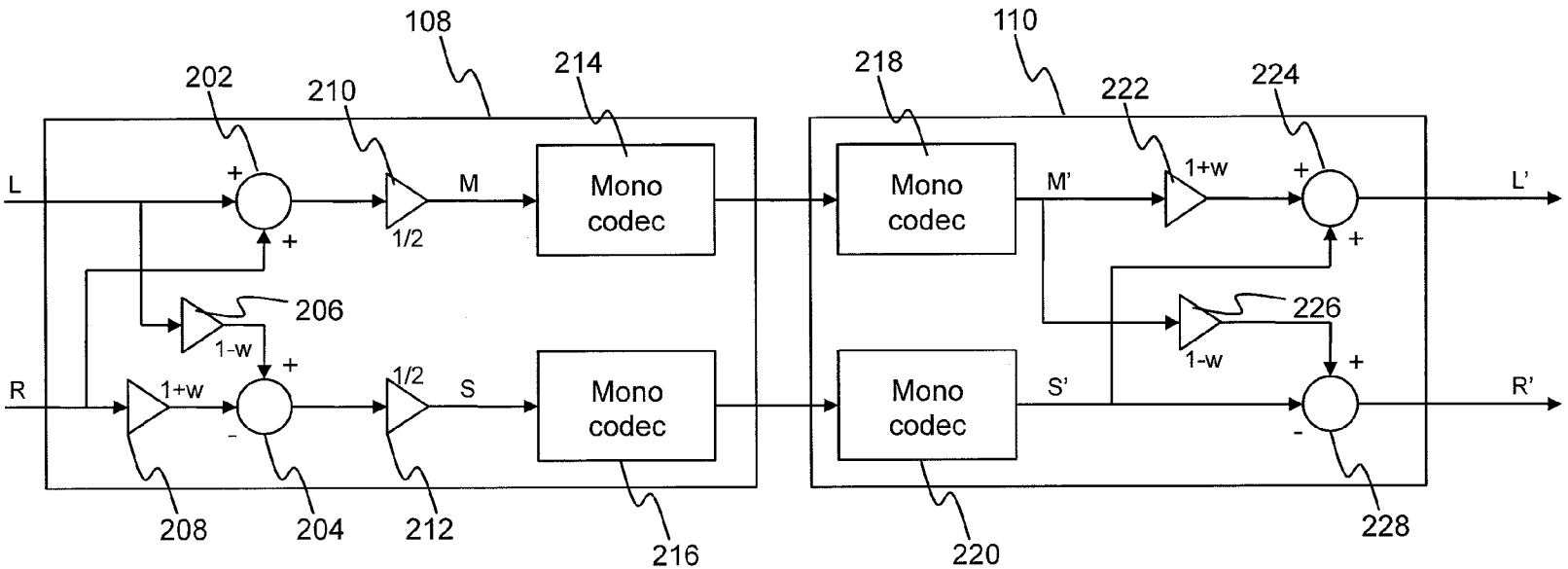
FIG. 2 shows an audio encoder block and an audio decoder block according to a first embodiment.

With reference to FIG. 2 there is now described an audio encoder block 108 and an audio decoder block 110 according to a first embodiment. The audio encoder block 108 comprises a first mixer 202, a second mixer 204, a first scaling element 206, a second scaling element 208, a third scaling element 210, a fourth scaling element 212, a first mono encoder 214 and a second mono encoder 216. The audio decoder block 110 comprises a first mono decoder 218, a second mono decoder 220, a fifth scaling element 222, a sixth scaling element 226, a third mixer 224 and a fourth mixer 228. The audio encoder block 108 is configured to receive input audio signals as left and right audio signals (L and R). The L audio signal is coupled to a first positive input of the first mixer 202 and to an input of the first scaling element 206. The R audio signal is coupled to a second positive input of the first mixer 202 and to an input of the second scaling element 208. An output of the first scaling element 206 is coupled to a positive input of the second mixer 204. An output of the second scaling element 208 is coupled to a negative input of the second mixer 204. An output of the first mixer 202 is coupled to an input of the third scaling element 210. An output of the third scaling element 210 (M) is coupled to an input of the first mono encoder 214. An output of the second mixer 204 is coupled to an input of the fourth scaling element 212. An output of the fourth scaling element 212 (S) is coupled to an input of the second mono encoder 214. An output of the first mono encoder 214 is coupled to an input of the first mono decoder 218 (e.g. via a transmitter of the first node 108 and a receiver of the second node 110). An output of the second mono encoder 216 is coupled to an input of the second mono decoder 220 (e.g. via a transmitter of the first node 108 and a receiver of the second node 110). An output of the first mono decoder 218 (M') is coupled to an input of the fifth scaling element 222 and to an input of the sixth scaling element 226. An output of the fifth scaling element 222 is coupled to a first positive input of the third mixer 224. An output of the sixth scaling element 226 is coupled to a positive input of the fourth mixer 228. An output of the second mono decoder 220 is coupled to a second positive input of the third mixer 224 and to a negative input of the fourth mixer 228. An output of the third mixer 224 (L') is output from the audio decoder block 110. An output of the fourth mixer 228 (R') is output from the audio decoder block 110.

Figure 3:
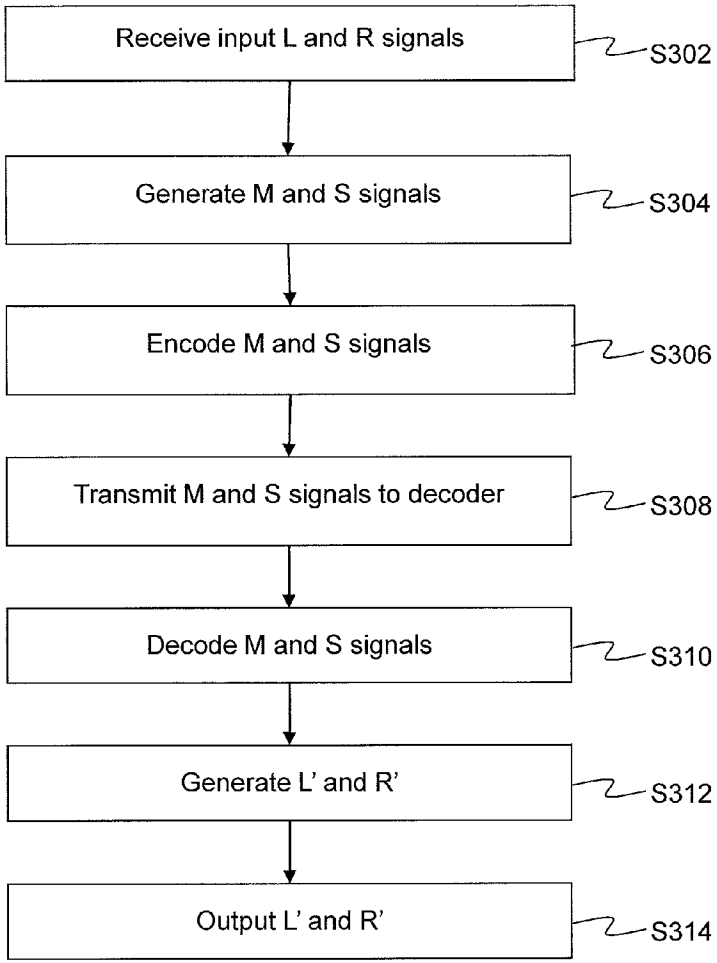
FIG. 3 is a flow chart for a process of processing a stereophonic audio signal according to a preferred embodiment.

The operation of the encoder block 108 and decoder block 110 is now described with reference to the flow chart of FIG. 3.

In step S302 the input audio signals (L and R) are received at the encoder block 108 from the microphones 106. In step S304 the L and R signals are used to generate the mid (M) and side (S) signals. In order to do this, the L signal is summed with the R signal by the mixer 202. The output of the mixer 202 is scaled by a factor of a half by the scaling element 210 to provide the mid signal, M. Therefore, it can be seen that the mid signal M is given by M=(L+R)/2. The L signal is scaled by a factor of 1−w by the scaling element 206 and the R signal is scaled by a factor of 1+w by the scaling element 208. The mixer 204 then finds the difference between the scaled L and R signals. That is to say the mixer 204 subtracts the output of the scaling element 208 from the output of the scaling element 206. The output of the mixer 204 is scaled by a factor of a half by the scaling element 212 to provide the side signal, S. Therefore, it can be seen that the mid signal (M) and the side signal (S) are given by the equations:

$$M=\tfrac{1}{2}(L+R); \tag{1a}$$

$$S=\tfrac{1}{2}((1-w)L-(1+w)R). \tag{1b}$$

The scaling parameter, w, is chosen to be in the range $-1 \le w \le 1$.

In step S306, the mid signal, M, is encoded by the mono encoder 214 and the side signal S is encoded by the mono encoder 216. The two audio signals (M and S) are therefore encoded separately. A skilled person would be aware of available techniques for encoding the audio signals M and S in the mono encoders 214 and 216 and, as such, the precise details of the operation of the mono encoders 214 and 216 is not discussed herein.

In step S308 the encoded M and S signals are transmitted from the first node 102 to the second node 104. The scalar parameter w is quantised and transmitted with the encoded M and S signals from the first node 102 to the second node 104. The encoded M and S signals and the scalar parameter w are received at the audio decoder block 110 of the second node 110. In particular the encoded M signal is received at the first mono decoder 218 and the encoded S signal is received at the second mono decoder 220.

In step S310 the encoded M and S signals are decoded. The first mono decoder 218 decodes the encoded M signal to provide a mid signal (M') and the second mono decoder 220 decodes the encoded S signal to provide a side signal (S'). The decoded M' and S' signals are denoted with primes because they may not exactly match the M and S signals which are input to the mono encoders 214 and 216 at the first node 102. If the encoding and decoding processes of the mono codecs 214, 216, 218 and 220 are perfect and if the transmission of the encoded M and S signals between the first and second nodes 102 and 104 is completely lossless then the decoded signals M' and S' may be the same as the M and S signals input to the mono encoders 214 and 216. However, in real, physical systems, the encoding and decoding process may not be perfect and there is likely to be some loss or distortion of the encoded M and S signals as they are transmitted between the first node 102 and the second node 104 and as such, M' might not equal M and S' might not equal S.

In step S312 left and right signals (L' and R') are generated in the audio decoder block 110 from the decoded M' and S' signals. The audio decoder block 110 receives the scalar parameter, w, with the encoded audio signals and uses the received value of the scalar parameter to set the scaling factors applied by the scaling elements 222 and 226. The M' signal is scaled by a factor of (1+w) by the scaling element 222 and then the scaled M' signal is summed with the S' signal by the mixer 224. The output of the mixer 224 is used as the L' signal. The M' signal is scaled by a factor of (1−w) by the scaling element 226 and then the mixer 228 finds the difference between the scaled M' signal and the S' signal. That is, the mixer 228 subtracts the S' signal from the output of the scaling element 226. The output of the mixer 228 is used as the R' signal. Therefore, it can be seen that the left signal, L', and the right signal, R', are given by the equations:

$$L'=(1+w)M'+S'; \tag{2a}$$

$$R'=(1-w)M'-S'. \tag{2b}$$

The L' and R' signals are output from the audio decoder block 110 and passed to the speakers 112. In step S314 the L' and R' signals are output from the speakers 112 to thereby output a stereophonic audio signal from the second node 104, e.g. to a user of the second node 104.

It can be seen in equations 1a and 1b above that the mid signal (M) corresponds to the mono version of the two input channels (L and R), and that the side signal (S) comprises the difference between a scaled version of L and a scaled version of R. As described above, a mono implementation of the decoder uses less CPU and memory resources than a full stereo implementation of the decoder. The reason for this complexity saving is that a mono decoder only needs to decode the part of the bitstream of the transmitted stereophonic audio signal that contains the mono representation (i.e. the encoded M signal), and can ignore the other part (i.e. the encoded S signal). In practice this may reduce complexity and memory consumption in the decoder by approximately half. This makes a mono decoder easier to implement and run on low-end hardware or gateways handling large numbers of calls, and saves battery life which is particularly important where, for example, the decoder is operated in a mobile device. A device in which the decoder is implemented might not have stereo playback capabilities (e.g. the second node 104 may only have one speaker 112) and, as such, a stereo decoder would not improve perceived audio quality. Using the method described herein, a mono decoder would still be compatible with the converted stereophonic audio signal bitstream format.

The scaling parameter w can be adjusted such that the side signal S can be made zero whenever the L and R signals differ only in a scale factor. The scaling parameter w can be adjusted during operation to thereby ensure that the side signal S is minimised throughout the whole process. In particular, the L and R signals can be analysed to determine how to set w, and therefore how to adjust the scaling applied to the L and R signals. The scaling parameter is maintained within the range $-1 \leq w \leq 1$ which advantageously ensures that there is no amplification of quantisation noise in the L and R signals.

It can be seen that the scaling factors applied to the L and R signals by the scaling elements 206 and 208 are dependent upon each other. In other words, if the scaling factor applied to the L signal changes then so does the scaling factor applied to the R signal. In fact, the scaling factors (1−w) and (1+w) always sum to a constant. In the preferred embodiments described above they add to two. The scaling applied by the scaling element 212 halves the output of the mixer 204. In this way the value of the scaling parameter w sets the proportions of L and R which are passed to the mixer 204. As described above, it is advantageous to reduce the amount of data required to represent the side signal S to thereby improve coding efficiency and audio quality of the stereophonic audio signal.

As an example, S can be made to be zero by setting the scaling parameter, w, to be zero when the left and right input audio signals are identical (i.e. when L=R). In these preferred embodiments, S can also be made to be zero when the left input audio signal is zero by setting the scaling parameter, w to be equal to minus one. Furthermore, in these preferred embodiments, S can also be made to be zero when the right input audio signal is zero by setting the scaling parameter, w to be equal to one. Therefore in preferred embodiments, the scaling parameter w is set in accordance with the results of an analysis of the L and R signals to thereby minimise the energy of the side signal, S.

As described above, the scaling parameter, w, may be optimized for maximum coding efficiency and audio quality. A good approximation towards that goal is to choose w such that the energy of the side signal S is minimized. That may be achieved with the least-squares solution:

$$w=\tfrac{1}{2}(L-R)^T M/(M^T M),$$

where L, R and M are represented as column vectors and $(.)^T$ denotes a transpose function. Since the scaling parameter, w, is coded and transmitted to the decoder, it is advantageously sampled at a sampling rate lower than that of the audio signal. One approach is to send one w value per frame or subframe of the stereophonic audio signal. To avoid discontinuities it is advantageous to interpolate w over time.

As described above, minimising the energy of the S signal improves audio quality in the converted stereophonic audio signal by avoiding artefacts in the stereo image which may lead to binaural unmasking.

Figure 4:
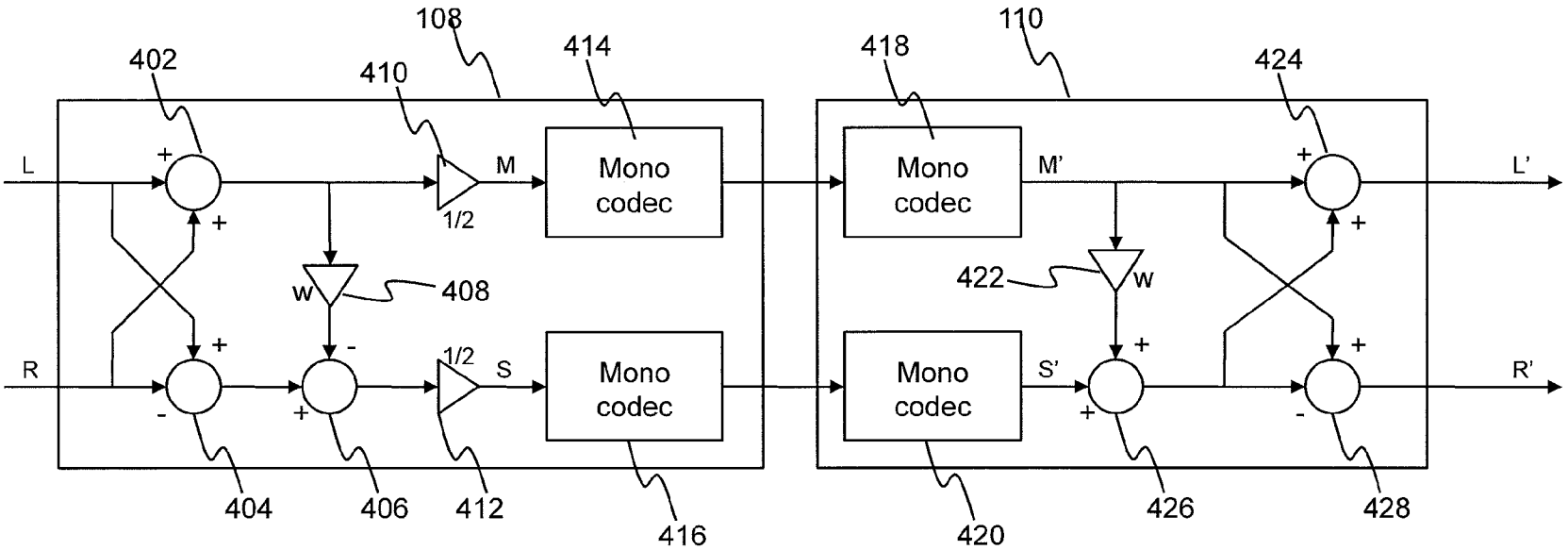
FIG. 4 shows an audio encoder block and an audio decoder block according to a second embodiment.

With reference to FIG. 4 there is now described an audio encoder block 108 and an audio decoder block 110 according to a second embodiment. The audio encoder block 108 and audio decoder block 110 of the second embodiment achieve the same result as that of the first embodiment but in a different way.

The audio encoder block 108 comprises a first mixer 402, a second mixer 404, a third mixer 406, a first scaling element 408, a second scaling element 410, a third scaling element 412, a first mono encoder 414 and a second mono encoder 416. The audio decoder block 110 comprises a first mono decoder 418, a second mono decoder 420, a fourth scaling element 422, a fourth mixer 424, a fifth mixer 426 and a sixth mixer 428. The audio encoder block 108 is configured to receive the L and R signals from the microphones 106. The L signal is coupled to a first positive input of the mixer 402 and to a positive input of the mixer 404. The R signal is coupled to a second positive input of the mixer 402 and to a negative input of the mixer 404. An output of the mixer 402 is coupled to inputs of the scaling elements 408 and 410. An output of the scaling element 408 is coupled to a negative input of the mixer 406. An output of the mixer 404 is coupled to a positive input of the mixer 406. An output of the mixer 406 is coupled to an input of the scaling element 412. An output of the scaling element 410 is coupled to an input of the mono encoder 414. An output of the scaling element 412 is coupled to an input of the mono encoder 416. An output of the mono encoder 414 is coupled to an input of the mono decoder 418. An output of the mono encoder 416 is coupled to an input of the mono decoder 420. An output of the mono decoder 418 is coupled to a first positive input of the mixer 424, to a positive input of the mixer 428 and to an input of the scaling element 422. An output of the scaling element 422 is coupled to a first positive input of the mixer 426. An output of the mono decoder 420 is coupled to a second positive input of the mixer 426. An output of the mixer 426 is coupled to a second positive input of the mixer 424 and to a negative input of the mixer 428. An output of the mixer 424 is output from the audio decoder bock 110 as the L' signal. An output of the mixer 428 is output from the audio decoder bock 110 as the R' signal.

The audio encoder shown in FIG. 4 provides the same M and S signals as described above in relation to FIG. 2, and therefore results in the same advantages as described above in relation to FIG. 2, but this is achieved in a different manner. The M signal is generated in the same way, that is, by summing the L and R signals and then scaling the result by a factor of a half.

However, the S signal is generated by first finding the difference between the L and R signals using mixer 404, that is, by subtracting the R signal from the L signal. The sum of the L and R signals is scaled by a factor of w by the scaling element 408 and then the mixer 406 finds the difference between the output of the mixer 404 and the output of the scaling element 408, that is, by subtracting the output of the scaling element 408 from the output of the mixer 404. The output of the mixer 406 is then scaled by a factor of a half to generate the S signal. These operations can be expressed using the following equations:

$$M=\tfrac{1}{2}(L+R); \tag{3a}$$

$$S=\tfrac{1}{2}(L-R)-wM. \tag{3b}$$

It will be appreciated that equation 3a is identical to equation 1a. Furthermore, with some re-arranging of the equation, equation 3b is identical to equation 1b. Therefore the audio encoder block 108 shown in FIG. 4 achieves the same result as the audio encoder block 108 shown in FIG. 2.

The audio decoder shown in FIG. 4 provides the same L' and R' signal as described above in relation to FIG. 2, and therefore results in the same advantages as described above in relation to FIG. 2, but this is achieved in a different manner. The decoded mid signal M' is scaled by a factor of w in the scaling element 422 and then the mixer 426 sums the output of the scaling element 422 with the decoded side signal S'. The output of the mixer 426 is summed with the M' signal in mixer 424 to provide the L' signal. The mixer 428 determines the difference between the M' signal and the output of the mixer 426. That is, the M' signal is subtracted from the output of the mixer 426, to provide the R' signal. The L' and R' signals are therefore given by the same equations (equations 2a and 2b) as given above in relation to FIG. 2, that is:

$$L'=(1+w)M'+S'; \tag{4a}$$

$$R'=(1-w)M'-S'. \tag{4b}$$

Figure 5:
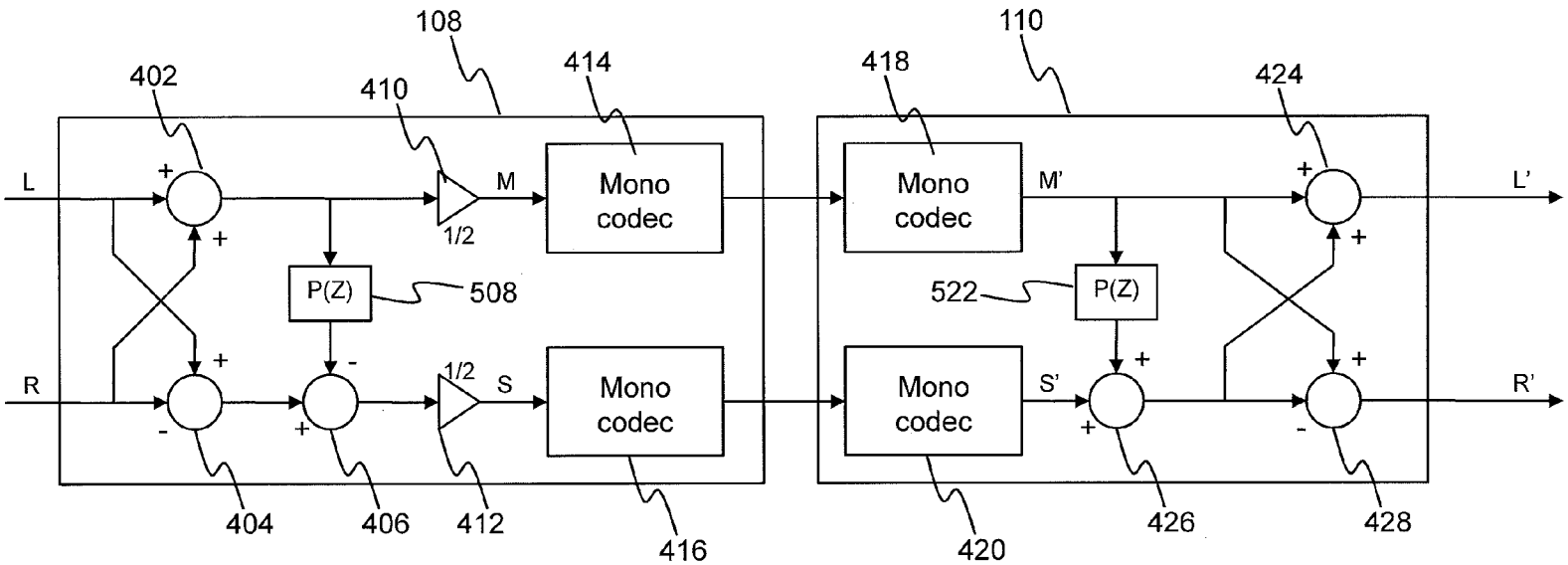
FIG. 5 shows an audio encoder block and an audio decoder block according to a third embodiment.

With reference to FIG. 5 there is now described an audio encoder block 108 and an audio decoder block 110 according to a third embodiment. The third embodiment is similar to the second embodiment and as such corresponding elements shown in FIGS. 4 and 5 are denoted with corresponding reference numerals.

The difference between the third embodiment (shown in FIG. 5) and the second embodiment (shown in FIG. 4) is that the scaling element 408 is replaced with a filter 508 having filter coefficients P(Z) and that the scaling element 422 is replaced with a filter 522 having filter coefficients P(Z). In this way, the third embodiment replaces the scalar parameter w by a filter P(z), as shown in FIG. 5. The output of the filter 508 represents a prediction of the difference signal (L−R) based on the sum signal (L+R). The filter coefficients can be chosen so that the signal S is minimized in energy. The filter coefficients are quantized and transmitted to the audio decoder block 110. The audio decoder block 110 uses the filter coefficients received from the audio encoder block 108 to apply the correct filter coefficients in the filter 522 to thereby recover the L' and R' signals correctly from the M' and S' signals.

In all of the embodiments described herein the decoder conversion process in the audio decoder block 110 that computes L' and R' from M' and S' is the exact inverse of the encoder conversion process in the audio encoder block 108 that computes M and S from L and R. This means the system implements perfect reconstruction: if the mono encoders and decoders are lossless (i.e., introduce no coding errors), the left and right output signals (L' and R') can be arbitrarily close to the input signals (L and R).

The method can be combined with a method of switching to a dual-mono coding mode whenever doing so would improve coding efficiency or audio quality of the encoded stereophonic audio signal, depending on the input signal. The switch in coding technique is signalled to the audio decoder block 110 so that the audio decoder block 110 can correctly decode the encoded stereophonic audio signal.

The methods described herein can be applied in the time domain, on subband signals or on transform domain coefficients. When the method operates in the time domain, it may be advantageous to time-align the left and right signals (L and R), as described in "Flexible Sum-Difference Stereo Coding Based on Time Aligned Signal Components", J. Lindblom, J. H. Plasberg, R. Vafin, IEEE Workshop on Applications of Signal Processing to Audio and Acoustics, October 2005. Such time alignment is done by delaying the left and right input signals L and R with independent, adaptive delays in the encoder. In the decoder the output signals L' and R' are delayed as well, such that the relative timing between these signals is made equal to that of the input signals L and R.

In the embodiments described above the encoded stereophonic audio signal is transmitted to another node at which it is decoded. In alternative embodiments, the encoded stereophonic signal is not transmitted to another node and may instead be decoded at the same node at which it is encoded (e.g. the first node 102). For example, the encoded stereophonic audio signal may be stored in a store at the first node 102. Subsequently the encoded stereophonic audio signals could be retrieved from the store and decoded at the first node 102 using an audio decoder block corresponding to block 110 described above and the L' and R' signals can be output at the first node 102, e.g. using speakers of the first node 102.

The methods and functional elements described above may be implemented in software or hardware. For example, if the audio encoder block 108 and the audio decoder block 110 are implemented in software they may be implemented by executing one or more computer program product(s) using computer processing means at the first and/or second node 102 and/or 104.

The audio encoder block 108 and the audio decoder block 110 described above operate in the digital domain, i.e. the audio signals are digital audio signals. In alternative embodiments, the audio encoder block 108 and the audio decoder block 110 may operate in the analogue domain, wherein the audio signals are analogue audio signals.

In another example, the M and S signals may be generated according to the equations:

$$M=0.4L+0.6R \text{ and}$$

$$S=0.4(1-w)L-0.6(1+w)R.$$

In this example, the S signal can still be minimised by adjusting the scaling parameter w accordingly. However, the M signal no longer represents the mono version of the stereophonic audio signal.

In this example, the decoder can still operate in the same way, that is according to the equations:

$$L'=(1+w)M'+S' \text{ and}$$

$$R'=(1-w)M'-S'.$$

Therefore it can be seen that the precise method used to encode the M and S signals may not be the same in all cases for the decoder to be able to decode the signals correctly.

Furthermore, while this invention has been particularly shown and described with reference to preferred embodiments, it will be understood to those skilled in the art that various changes in form and detail may be made without departing from the scope of the invention as defined by the appendant claims.

What is claimed is:

1. A method of processing an input stereophonic audio signal to thereby generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the method comprising:

generating the first converted audio signal, wherein the first converted audio signal is based on the sum of the left input audio signal and the right input audio signal; and generating the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

2. The method of claim 1 further comprising encoding the first and second converted audio signals using respective mono encoders.

3. The method of claim 1 further comprising transmitting the converted stereophonic audio signal with an indication of the first and second functions to a decoder.

4. The method of claim 3 wherein the indication is transmitted once per frame of the stereophonic audio signal.

5. The method of claim 1 further comprising:

analysing the right and left input audio signals to determine optimum functions for the first and second functions; and adjusting the first and second functions in accordance with the determined optimum functions.

6. The method of claim 5 wherein the optimum functions are determined so as to minimise the second converted audio signal.

7. The method of claim 1 wherein the first and second functions are dependent upon each other.

8. The method of claim 7 wherein the sum of the first and second functions is constant as the functions are adjusted.

9. The method of claim 1 wherein the first converted audio signal, M, and the second converted audio signal, S, are given by:

$$M = \frac{1}{2}(L+R) \text{ and } S = \frac{1}{2}[(1-w)L-(1+w)R],$$

where L and R denote the left and right input audio signals respectively and w is a scaling parameter, wherein the first function is given by (1−w) and the second function is given by (1+w).

10. The method of claim 1 wherein the at least one characteristic of the converted stereophonic audio signal comprises at least one of a coding efficiency and an audio quality of the converted stereophonic audio signal.

11. The method of claim 1 further comprising:

analysing the right and left input audio signals; and switching to a dual-mono coding mode if the analysis of the right and left input audio signals indicates that doing so would improve the coding efficiency or the audio quality of the converted stereophonic audio signal.

12. The method of claim 1 wherein the step of generating the second converted audio signal comprises:

applying the first function to the left input audio signal to generate an adjusted left input audio signal;

applying the second function to the right input audio signal to generate an adjusted right input audio signal; and determining the difference between the adjusted left input audio signal and the adjusted right input audio signal.

13. The method of claim 1 wherein the method comprises:

determining the sum of the left and right input audio signals;

determining the difference between the left and right input audio signals; and applying an adjusting function to the determined sum of the left and right input audio signals to generate an adjusting signal, wherein the second converted audio signal is generated based on the difference between the adjusting signal and the determined difference between the left and right input audio signals.

14. The method of claim 1 wherein the first and second functions are first and second scaling factors.

15. The method of claim 1 wherein the first and second functions are determined by filter coefficients of a prediction filter.

16. A computer-readable storage device comprising code configured so as when executed on one or more processors of an apparatus, the code processes an input stereophonic audio signal to thereby generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the converted stereophonic audio signal generated, the converted stereophonic audio signal being generated by:

generating the first converted audio signal, wherein the first converted audio signal is based on the sum of the left input audio signal and the right input audio signal; and generating the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

17. An apparatus for processing an input stereophonic audio signal to thereby generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the apparatus comprising:

first generating means configured to generate the first converted audio signal, wherein the first converted audio signal is based on the sum of the left input audio signal and the right input audio signal; and second generating means configured to generate the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

18. The apparatus of claim 17 further comprising:

a first mono encoder configured to encode the first converted audio signal; and a second mono encoder configured to encode the second converted audio signal.

19. The apparatus of claim 17 further comprising a transmitter configured to transmit the converted stereophonic audio signal with an indication of the first and second functions to a decoder.

20. A method of generating an output stereophonic audio signal from a converted stereophonic audio signal which has been generated from an input stereophonic audio signal, said input stereophonic audio signal comprising a left input audio signal and a right input audio signal, and said converted stereophonic audio signal comprising a first converted audio signal and a second converted audio signal which are related to the left and right input audio signals according to at least one function, said output stereophonic audio signal comprising a left output audio signal and a right output audio signal, the method comprising:

receiving the first and second converted audio signals with an indication of said at least one function;

generating the right output audio signal, wherein the right output audio signal is based on the sum of the second converted audio signal and a first decoding function of the first converted audio signal; and generating the left output audio signal, wherein the left output audio signal is based on the difference between the second converted audio signal and a second decoding function of the first converted audio signal, wherein the first and second decoding functions are determined in accordance with the received indication of the at least one function such that the generated left and right output audio signals represent the left and right input audio signals.

21. The method of claim 20 wherein (i) the first converted audio signal is based on the sum of the left input audio signal and the right input audio signal, and (ii) the second converted audio signal is based on the difference between a first function of the left input audio signal and a second function of the right input audio signal, and wherein the at least one function comprises the first function and the second function.

22. The method of claim 20 wherein the converted stereophonic audio signal has been generated by:

generating the first converted audio signal, wherein the first converted audio signal is based on the sum of the left input audio signal and the right input audio signal; and generating the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal.

23. The method of claim 20 further comprising decoding the received first and second converted audio signals using respective mono decoders prior to said steps of generating the right output audio signal and generating the left output audio signal.

24. The method of claim 20 further comprising outputting the output stereophonic audio signal.

25. The method of claim 20 wherein the left output audio signal, L', and the right output audio signal, R', are given by:

$$L'=(1+w)M'+S' \text{ and } R'=(1-w)M'-S',$$

where M' and S' denote the received first and second converted audio signals respectively and w is a scaling parameter, wherein the first decoding function is given by (1−w) and the second decoding function is given by (1+w).

26. A computer-readable storage device comprising code configured so as when executed on one or more processors of an apparatus to perform the operations in accordance with claim 20.

27. An apparatus for generating an output stereophonic audio signal from a converted stereophonic audio signal which has been generated from an input stereophonic audio signal, said input stereophonic audio signal comprising a left input audio signal and a right input audio signal, and said converted stereophonic audio signal comprising a first converted audio signal and a second converted audio signal which are related to the left and right input audio signals according to at least one function, said output stereophonic audio signal comprising a left output audio signal and a right output audio signal, the apparatus comprising:

a receiver configured to receive the first and second converted audio signals with an indication of said at least one function;

first generating means configured to generate the right output audio signal, wherein the right output audio signal is based on the sum of the second converted audio signal and a first decoding function of the first converted audio signal;

second generating means configured to generate the left output audio signal, wherein the left output audio signal is based on the difference between the second converted audio signal and a second decoding function of the first converted audio signal, and determining means configured to determine the first and second decoding functions in accordance with the received indication of the at least one function such that the generated left and right output audio signals represent the left and right input audio signals.

28. The apparatus of claim 27 further comprising:

a first mono decoder configured to decode the received first converted audio signal; and a second mono decoder configured to decode the received second converted audio signal.

29. A system comprising:

a first apparatus configured to process an input stereophonic audio signal to generate a converted stereophonic audio signal representing the input stereophonic audio signal, said input stereophonic audio signal comprising a left input audio signal and a right input audio signal, and said converted stereophonic audio signal comprising a first converted audio signal and a second converted audio signal, the first apparatus including:

first generating means configured to generate the first converted audio signal, wherein the first converted audio signal is based on the sum of the left input audio signal and the right input audio signal; and second generating means configured to generate the second converted audio signal, wherein the second converted audio signal is based on the difference between a first function of the left input audio signal and a second function of the right input audio signal, and wherein the first and second functions are adjustable to thereby adjust at least one characteristic of the converted stereophonic audio signal; and a second apparatus configured to receive the converted stereophonic audio signal and for generating an output stereophonic audio signal from a converted stereophonic audio signal which has been generated from an input stereophonic audio signal, said input stereophonic audio signal comprising a left input audio signal and a right input audio signal, and said converted stereophonic audio signal comprising a first converted audio signal and a second converted audio signal which are related to the left and right input audio signals according to at least one function, said output stereophonic audio signal comprising a left output audio signal and a right output audio signal, the second apparatus including:

a receiver configured to receive the first and second converted audio signals with an indication of said at least one function;

first generating means configured to generate the right output audio signal, wherein the right output audio signal is based on the sum of the second converted audio signal and a first decoding function of the first converted audio signal;

second generating means configured to generate the left output audio signal, wherein the left output audio signal is based on the difference between the second converted audio signal and a second decoding function of the first converted audio signal, and determining means configured to determine the first and second decoding functions in accordance with the received indication of the at least one function such that the generated left and right output audio signals represent the left and right input audio signals.

* * * * *